US011142862B2

(12) United States Patent
Bensel et al.

(10) Patent No.: US 11,142,862 B2
(45) Date of Patent: Oct. 12, 2021

(54) BULK TANK DETERGENT RESERVOIR AND DISPENSER IN A WASHING MACHINE APPLIANCE

(71) Applicant: Haier US Appliance Solutions, Inc., Wilmington, DE (US)

(72) Inventors: Peter Hans Bensel, Louisville, KY (US); Alexander B. Leibman, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 181 days.

(21) Appl. No.: 16/416,528

(22) Filed: May 20, 2019

(65) Prior Publication Data

US 2020/0370229 A1 Nov. 26, 2020

(51) Int. Cl.
*D06F 39/02* (2006.01)

(52) U.S. Cl.
CPC ..... *D06F 39/024* (2013.01)

(58) Field of Classification Search
CPC ..... D06F 39/024
USPC ..... 68/17 A
See application file for complete search history.

(56) References Cited

U.S. PATENT DOCUMENTS

| | | | | |
|---|---|---|---|---|
| 2,868,006 | A | 1/1959 | Tingley, Jr. | |
| 3,048,993 | A | 8/1962 | Lucas et al. | |
| 3,724,242 | A * | 4/1973 | Davis | D06F 39/024 68/17 A |
| 4,118,957 | A | 10/1978 | Marcussen | |
| 6,301,734 | B1 * | 10/2001 | Dunsbergen | D06F 39/024 68/17 A |
| 2005/0028564 | A1 | 2/2005 | Lee | |
| 2018/0363215 | A1 * | 12/2018 | Pieretti | D06F 39/024 |

FOREIGN PATENT DOCUMENTS

| | | | |
|---|---|---|---|
| CN | 1244605 | A | 2/2000 |
| JP | 2001113090 | A | 4/2001 |
| JP | 2015080559 | A * | 4/2015 |

OTHER PUBLICATIONS

JP2015080559A—Machine translation (Year: 2015).*

* cited by examiner

*Primary Examiner* — Tinsae B Ayalew
(74) *Attorney, Agent, or Firm* — Dority & Manning, P.A.

(57) ABSTRACT

A washing machine appliance may include a base is mounted within a wash chamber and a bulk tank assembly is mounted to a top side of the base, the bulk tank assembly comprising an elongated reservoir for receiving and storing a cleaning agent and a reservoir cap removably mounted to the elongated reservoir and comprising a manual hand pump for selectively motivating a portion of the cleaning agent from the elongated reservoir.

14 Claims, 12 Drawing Sheets

BULK TANK DETERGENT RESERVOIR AND DISPENSER IN A WASHING MACHINE APPLIANCE

FIELD OF THE INVENTION

The present disclosure relates generally to washing machine appliances and more particularly to bulk tank detergent reservoirs mounted within washing machine appliances.

BACKGROUND OF THE INVENTION

Washing machine appliances generally include a cabinet which receives a tub for containing wash and rinse water. A wash basket is rotatably mounted within the wash tub. A drive assembly is coupled to the wash tub and configured to rotate the wash basket within the wash tub in order to cleanse articles within the wash basket. Upon completion of a wash cycle, a pump assembly can be used to rinse and drain soiled water to a draining system.

Prior to each wash cycle, cleaning agents such as detergent are manually added to the wash chamber. To accomplish this, users must handle large containers of such cleaning agents, often pouring a single-wash portion into a container cap in order to measure the proper amount and then dumping the contents of the cap into the wash chamber. In addition to the inconvenience of repeating this activity for each and every wash cycle, the constant handling and pouring from the heavy and cumbersome containers creates an increased risk of spillage, which can be difficult and time-consuming to clean up. Moreover, the containers must be stored until the contents are used up, taking up a significant amount of space, typically in laundry rooms or closets that have limited space to begin with.

Accordingly, a need exists for a bulk tank reservoir that may hold a large volume of cleaning agent in order that supplying cleaning agent for many washing cycles may involve only a single manual filling operation. It is also desirable that a bulk tank reservoir resides within a washing machine appliance and comes equipped with a dispenser to enable users to dispense a single-wash portion of cleaning agent without the need to store and utilize any containers or measuring devices.

BRIEF DESCRIPTION OF THE INVENTION

Aspects and advantages of the invention will be set forth in part in the following description, or may be obvious from the description, or may be learned through practice of the invention.

In one aspect of the present disclosure, a washing machine appliance is provided. The washing machine appliance may include a cabinet, a tub, a wash basket rotatably, a base, and a bulk tank assembly. The tub may be mounted within the cabinet. The wash basket may define a wash chamber. The base may have a top side being rotatable relative to the wash chamber. The bulk tank assembly may be mounted to the top side of the base and may further comprise an elongated reservoir and a reservoir cap. The elongated reservoir may define a reservoir volume to receive cleaning agent therein. The reservoir cap may be removably mounted to the elongated reservoir and may further comprise a manual hand pump in fluid communication with the reservoir volume to selectively motivate a portion of the cleaning agent from the reservoir volume.

In another aspect of the present disclosure, a washing machine appliance is provided. The washing machine appliance may include a cabinet, a tub, a wash basket rotatably, a base, and a bulk tank assembly. The tub may be mounted within the cabinet. The wash basket may define a wash chamber. The base may have a top side being rotatable relative to the wash chamber. The bulk tank assembly may be mounted to the top side of the base and may further comprise an elongated reservoir and a manual hand pump. The elongated reservoir may define a reservoir volume to receive cleaning agent therein. The manual hand pump may be mounted on a top of the elongated reservoir, wherein the pump may be actuated to dispense the cleaning agent.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
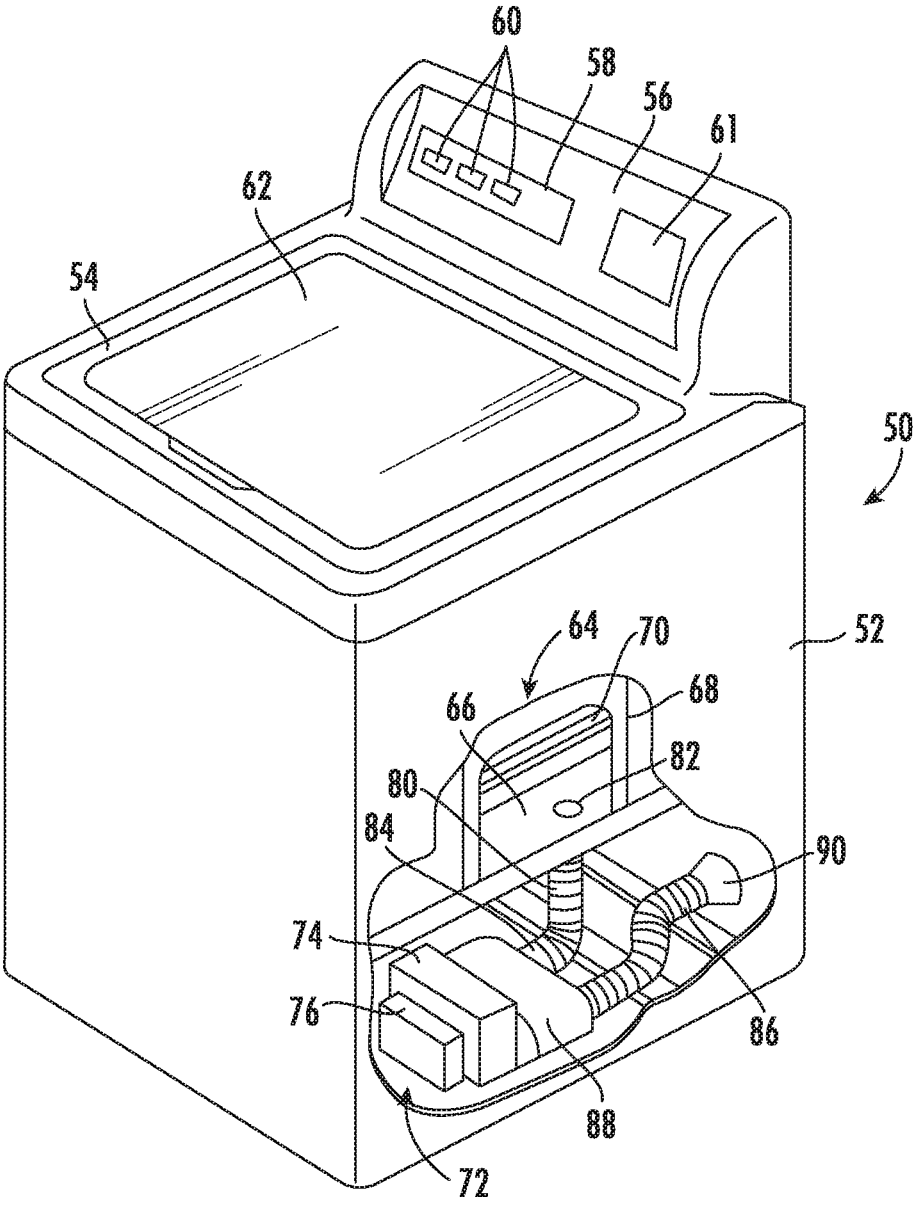
FIG. 1 provides a perspective view of a washing machine appliance according to exemplary embodiments of the present disclosure with a portion of a cabinet of the exemplary washing machine appliance shown broken away in order to reveal certain interior components of the exemplary washing machine appliance.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents In order to aid understanding of this disclosure, several terms are defined below. The defined terms are understood to have meanings commonly recognized by persons of ordinary skill in the arts relevant to the present invention. The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one component from another and are not intended to signify location or importance of the individual components.

Turning now to the figures, FIG. 1 provides a perspective view partially broken away of a washing machine appliance 50 according to an exemplary embodiment of the present disclosure. As may be seen in FIG. 1, washing machine appliance 50 includes a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment a display 61 indicates selected features, a countdown timer, and other items of interest to machine users. A lid 62 is mounted to cover 54 and is rotatable about a hinge (not shown) between an open position (not shown) facilitating access to a wash tub 64 located within cabinet 52, and a closed position (shown in FIG. 1) forming a sealed enclosure over wash tub 64.

Tub 64 includes a bottom wall 66 and a sidewall 68, and a basket 70 is rotatably mounted within wash tub 64. A pump assembly 72 is located beneath tub 64 and basket 70 for gravity assisted flow when draining tub 64. Pump assembly 72 includes a pump 74 and a motor 76. A pump inlet hose 80 extends from a wash tub outlet 82 in tub bottom wall 66 to a pump inlet 84, and a pump outlet hose 86 extends from a pump outlet 88 to an appliance washing machine water outlet 90 and ultimately to a building plumbing system discharge line (not shown) in flow communication with outlet 90.

Figure 2:
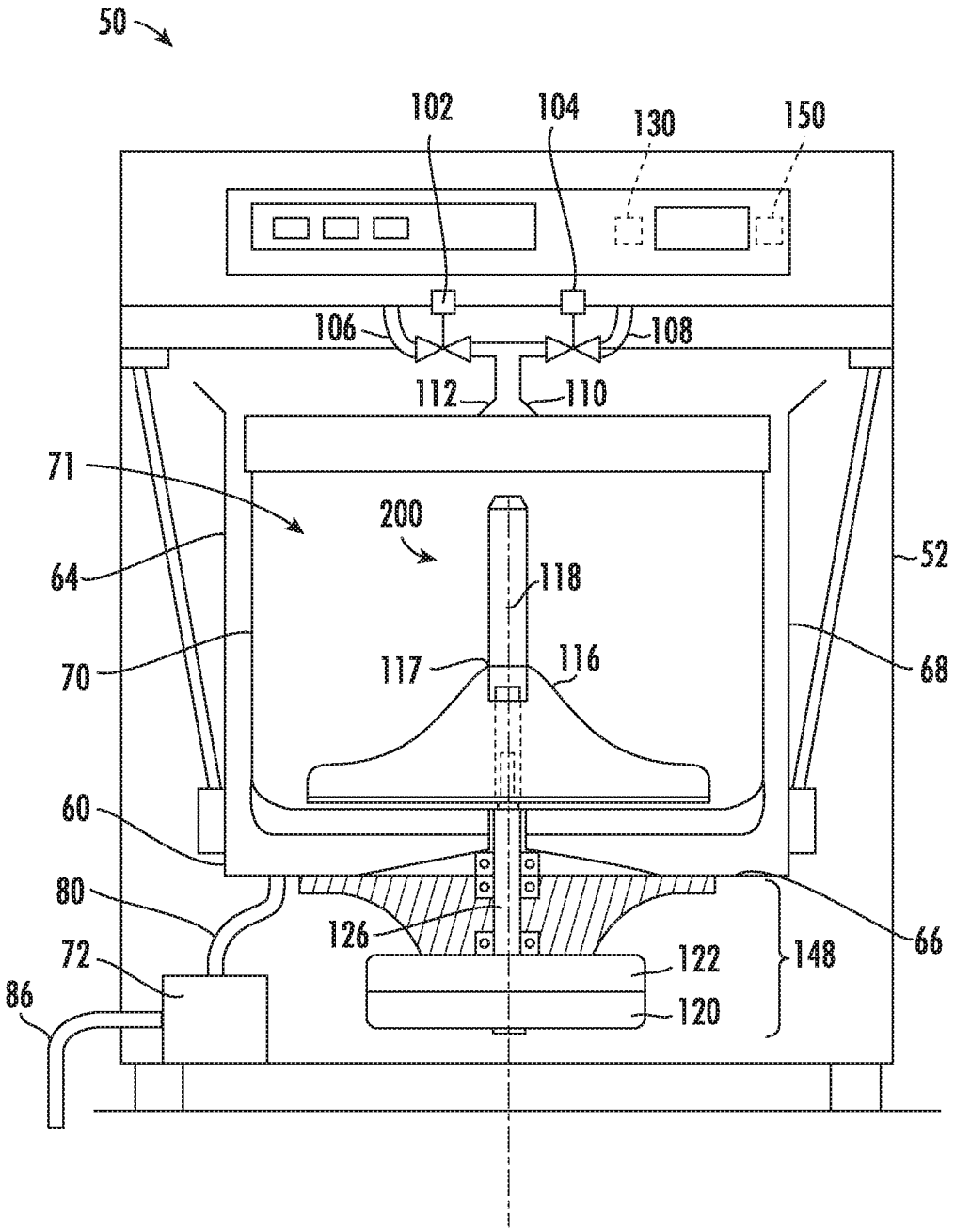
FIG. 2 provides a front elevation schematic view of certain components of the exemplary washing machine appliance of FIG. 1.

FIG. 2 provides a front elevation schematic view of certain components washing machine appliance 50 including wash basket 70 movably disposed and rotatably mounted in wash tub 64 in a spaced apart relationship from tub side wall 68 and tub bottom 66. Basket 70 includes a plurality of perforations therein to facilitate fluid communication between wash tub 64 and a wash chamber 71 defined by an interior of basket 70.

In some embodiments, a hot liquid valve 102 and a cold liquid valve 104 deliver fluid, such as water, to basket 70 and wash tub 64 through a respective hot liquid hose 106 and a cold liquid hose 108. Liquid valves 102, 104 and liquid hoses 106, 108 may together form a liquid supply connection for washing machine appliance 50 and, when connected to a building plumbing system (not shown), provide a fresh water supply for use in washing machine appliance 50. Liquid valves 102, 104 and liquid hoses 106, 108 are connected to a basket inlet tube 110, and fluid is dispersed from inlet tube 110 through a nozzle assembly 112 having a number of openings therein to direct washing liquid into basket 70 at a given trajectory and velocity. A dispenser (not shown in FIG. 2), may also be provided to produce a wash solution by mixing fresh water with a known detergent or other composition for cleansing of articles in basket 70.

A base 116 is disposed in basket 70 to impart an oscillatory motion to articles and liquid in basket 70. Base 116 may be rotatable relative to wash chamber 71. To accomplish the oscillation of articles and liquid in basket 70, base 116 may comprise a vane agitator base, an impeller, an auger base, or other known agitating element known art, whether used individually or in combination. As illustrated in FIG. 2, base 116 is oriented to rotate about a vertical axis 118.

In some embodiments, a bulk tank assembly 200 is further provided for containing and dispensing detergent or other cleaning agents for use in operation of washing machine appliance 50. Bulk tank assembly 200 may be connected to a top side 117 of base 116 through a suitable mechanical connection technique, including fixedly connecting bulk tank assembly 200 to base 116 using bolts, screws, etc., or removably connecting bulk tank assembly 200, for example, via a threaded connection.

In certain embodiments, basket 70, base 116, or bulk tank assembly 200 may be selectively driven by a motor 120 through a transmission and clutch system 122. For instance, the motor 120 may drive a shaft 126 to rotate basket 70 within wash tub 64. In some such embodiments, clutch system 122 facilitates driving engagement of basket 70, base 116, and bulk tank assembly 200 for rotatable movement within wash tub 64, and clutch system 122 facilitates relative rotation of basket 70 and base 116 (and consequently bulk tank assembly 200) for selected portions of wash cycles. Motor 120 and transmission and clutch system 122 collectively are referenced herein as a motor assembly 148.

Operation of washing machine appliance 50 is generally controlled by a controller 150 that is operatively coupled (e.g., electrically coupled or connected) to the input selectors 60 located on washing machine backsplash 56 (FIG. 1) for user manipulation to select washing machine cycles and features. In response to user manipulation of input selectors 60, controller 150 operates the various components of washing machine appliance 50 to execute selected machine cycles and features.

Controller 150 may include a memory (e.g., non-transitory storage media) and microprocessor, such as a general or special purpose microprocessor operable to execute programming instructions or micro-control code associated with a washing operation or cycle. The memory may represent random access memory such as DRAM, or read only memory such as ROM or FLASH. In one embodiment, the processor executes programming instructions stored in memory (e.g., as software). The memory may be a separate component from the processor or may be included onboard within the processor. Alternatively, controller 150 may be constructed without using a microprocessor, e.g., using a combination of discrete analog or digital logic circuitry (such as switches, amplifiers, integrators, comparators, flip-flops, AND gates, and the like) to perform control functionality instead of relying upon software. Control panel 58 and other components of washing machine appliance 50 (such as motor assembly 148 or measurement devices 130—discussed herein) may be in communication with controller 150 via one or more signal lines or shared communication busses to provide signals to or receive signals from the controller 150.

In an illustrative embodiment, articles (e.g., laundry items) are loaded into basket 70, and washing operation is initiated through operator manipulation of control input selectors 60 (shown in FIG. 1). Tub 64 is filled with water and mixed with detergent via operation of bulk tank assembly 200 to form a wash fluid, and basket 70 is agitated with base 116 for cleansing of laundry items in basket 70. That is, base 116 is moved back and forth in an oscillatory back and forth motion (e.g., while basket 70 remains generally stationary—i.e., not actively rotated). In the illustrated embodiment, base 116 is rotated clockwise a specified amount about the vertical axis 118 of the machine, and then rotated counterclockwise by a specified amount. The clockwise/counterclockwise reciprocating motion is sometimes referred to as a stroke, and the agitation phase of the wash cycle constitutes a number of strokes in sequence. Acceleration and deceleration of base 116 during the strokes imparts mechanical energy to articles in basket 70 for cleansing action. The strokes may be obtained in different embodiments with a reversing motor, a reversible clutch, or other known reciprocating mechanism. After the agitation phase of the wash cycle is completed, tub 64 is drained with pump assembly 72. Laundry items are then rinsed. Moreover, basket 70 may be rotated in a spin phase and portions of the cycle may be repeated, including the agitation phase, depending on the particulars of the wash cycle selected by a user.

Figure 3:
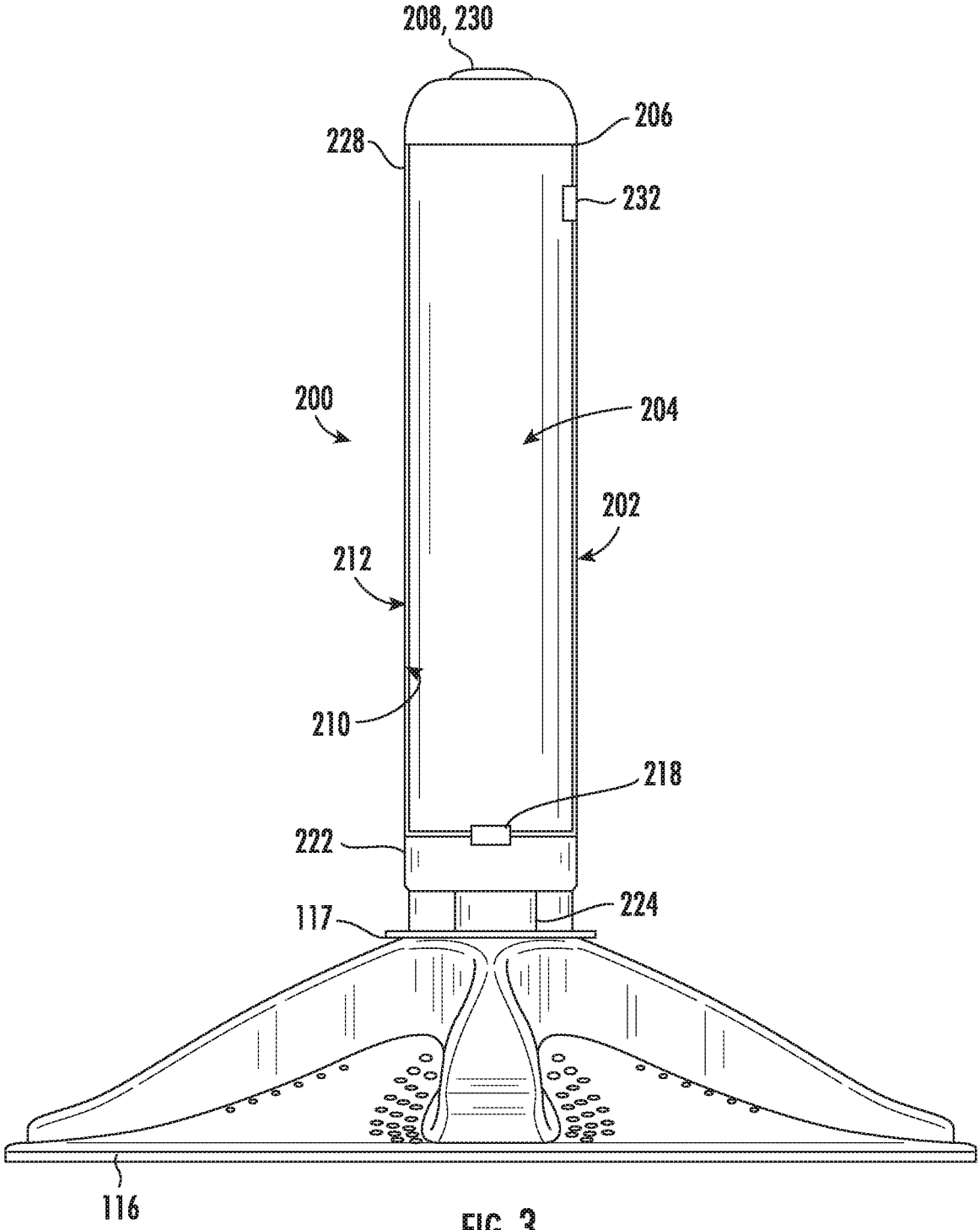
FIG. 3 provides a front perspective view of an exemplary bulk tank connected to an exemplary base.
Figure 4:
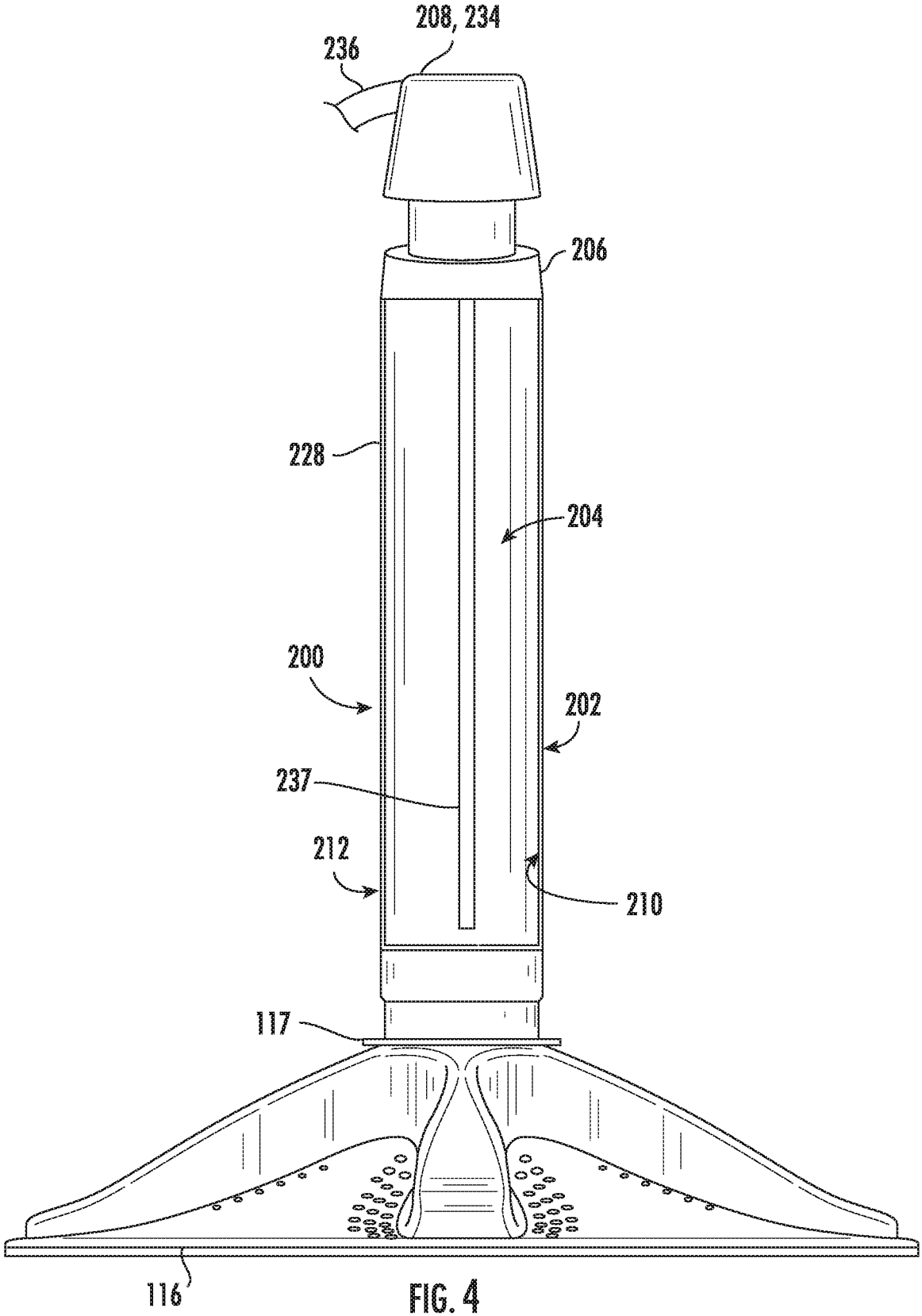
FIG. 4 provides a front perspective view of an exemplary bulk tank assembly connected to an exemplary base.
Figure 5:
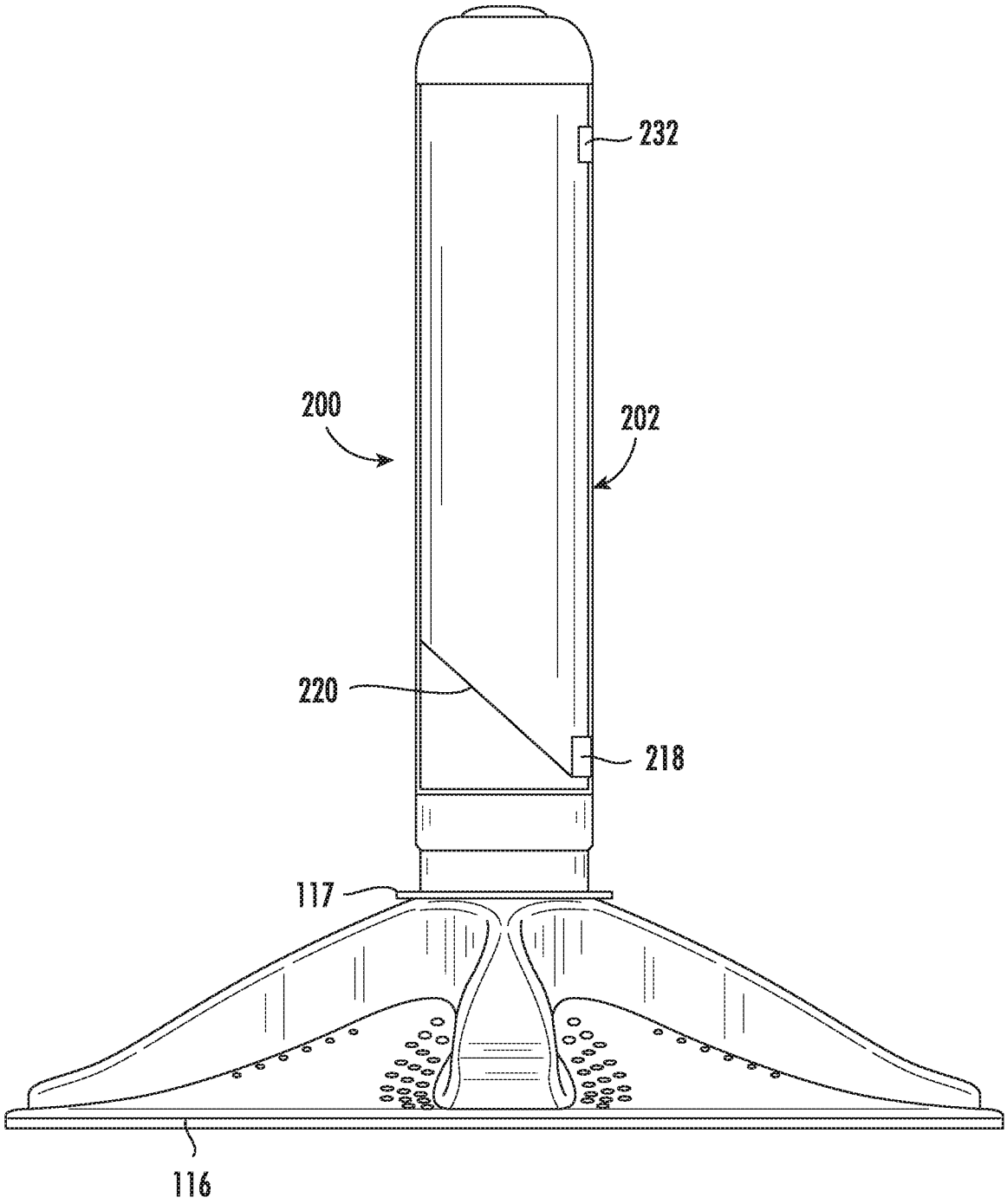
FIG. 5 provides a front perspective view of an exemplary bulk tank assembly connected to an exemplary base.

FIGS. 3 through 5 illustrate various embodiments of bulk tank assembly 200 as mounted on top side 117 of base 116. As shown in FIGS. 3 through 5, certain embodiments of bulk tank assembly 200 include an elongated reservoir 202 and a reservoir cap 206. Reservoir 202 may generally be hollow, defining a reservoir volume 204 so that reservoir 202 may receive and retain cleaning agents (e.g., a volume of one or more cleaning agents) therein. In some embodiments, reservoir 202 is generally cylindrical in shape, though any suitable shape of reservoir 202 may be employed consistent with the disclosure herein. The reservoir volume may be large enough to accommodate a significant volume of cleaning agent (e.g., 50-210 ounces of liquid detergent in some embodiments) which may be advantageously utilized over the course of numerous wash cycles, thereby relieving users from having to pour a volume of cleaning agent from its bottle for each individual wash cycle. Bulk tank assembly 200 may be removably mounted to base 116, for example, by one or more removable fasteners (e.g., bolts, screws, threaded connection). Alternatively, bulk tank assembly 200 may be fixedly mounted to or integral with base 116 (e.g., as a unitary, monolithic unit).

Figure 6:
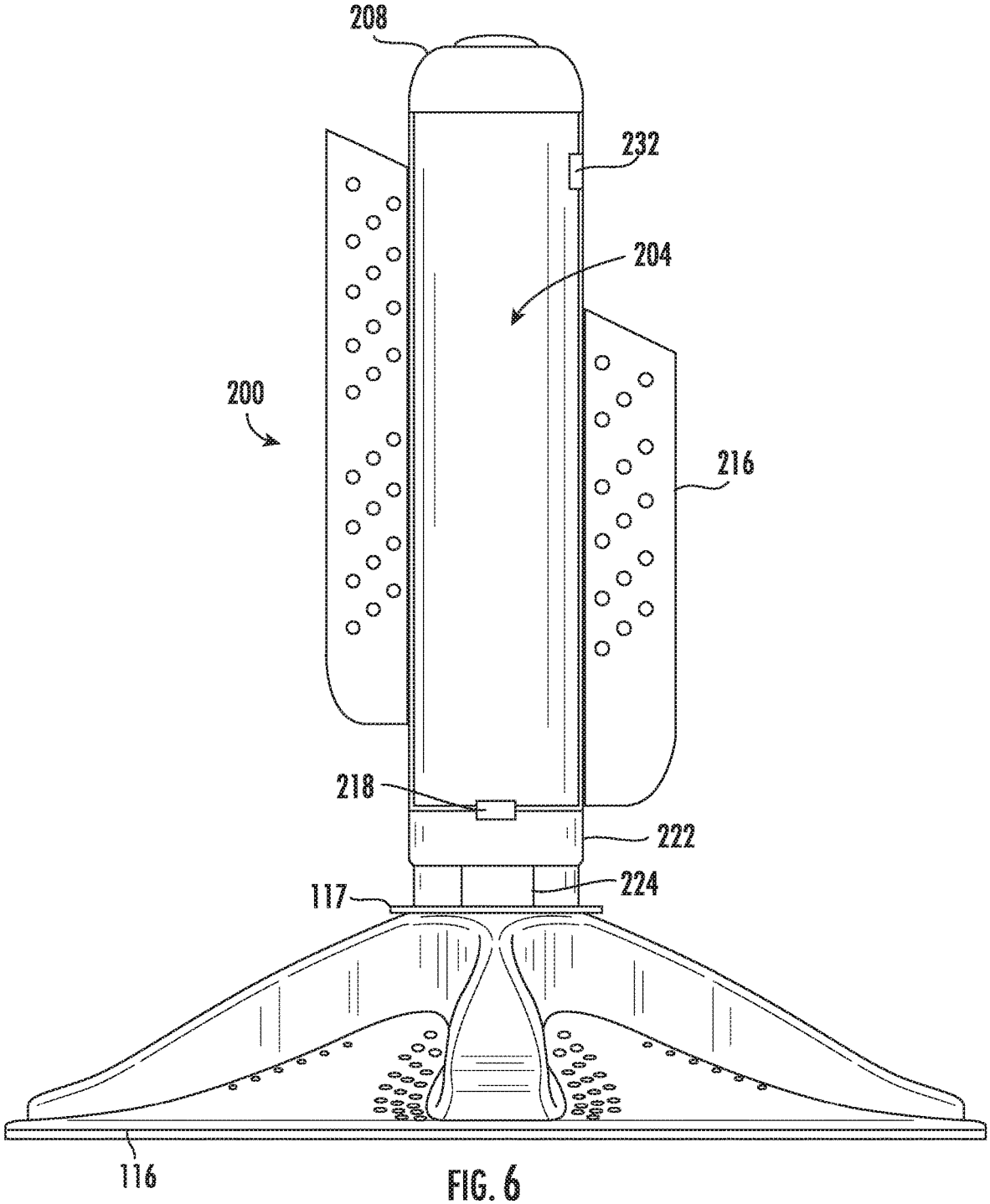
FIG. 6 provides a front perspective view of an embodiment of a bulk tank assembly connected to an exemplary base.

Reservoir 202 may include an inner surface 210 directed toward reservoir volume 204 and an outer surface 212 directed away from reservoir volume 204. Optionally, as shown in the embodiment of FIG. 6, reservoir 202 may further comprise vertical agitating fins 216 mounted on outer surface 212 of reservoir 202. When base 116, bulk tank assembly 200, reservoir 202, and agitating fins 216 are rotated during operation of machine appliance 50, agitating fins 216 may serve to oscillate articles and wash fluid in basket 70, thereby aiding the washing process. In certain embodiments, agitating fins 216 can be utilized as the sole oscillating mechanism for articles and wash fluid in basket 70. In alternative embodiments, agitating fins 216 can be used in combination with an impeller or other mechanisms for such oscillation.

Figure 7:
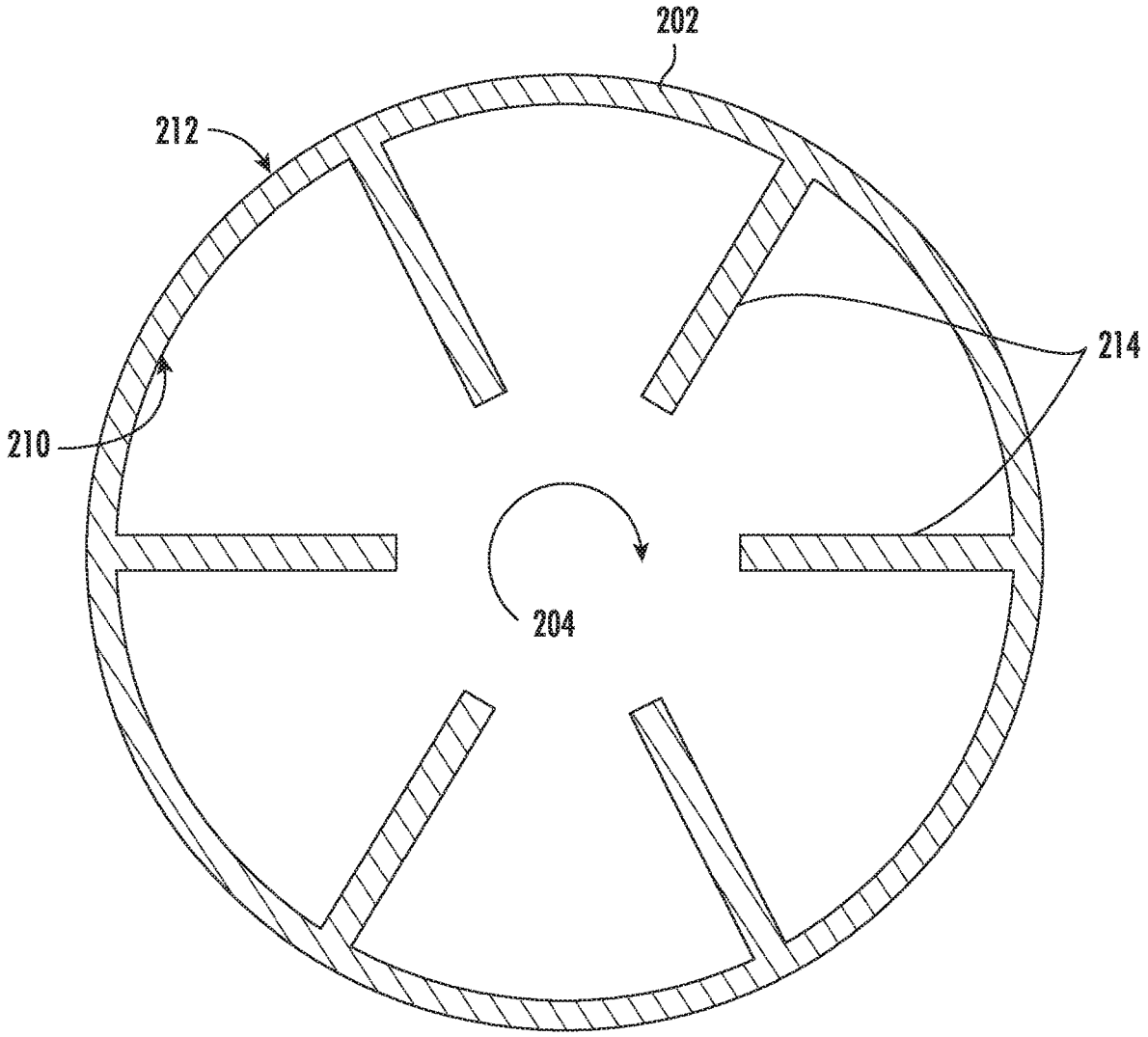
FIG. 7 provides a horizontal cross-sectional view of an exemplary reservoir.

Additionally or alternatively, reservoir 202 may further comprise a plurality of distribution ribs 214. As shown in the embodiment of FIG. 7, distribution ribs 214 may extend from inner surface 210 of reservoir 202 within reservoir volume 204. Generally, distribution ribs 214 can serve to impede the movement of cleaning agents within reservoir 202 during operation of washing machine appliance 50. Absent distribution ribs 214, the rotation of reservoir 202 during a wash cycle may cause the cleaning agents therein to slosh toward one side of reservoir 202, potentially creating an imbalance within washing machine appliance 50. Distribution ribs 214 may advantageously provide barriers to the movement of liquid cleaning agents, thus preventing the cleaning agents from collecting along a single singe of reservoir 202 and avoid such an imbalance.

Figure 8:
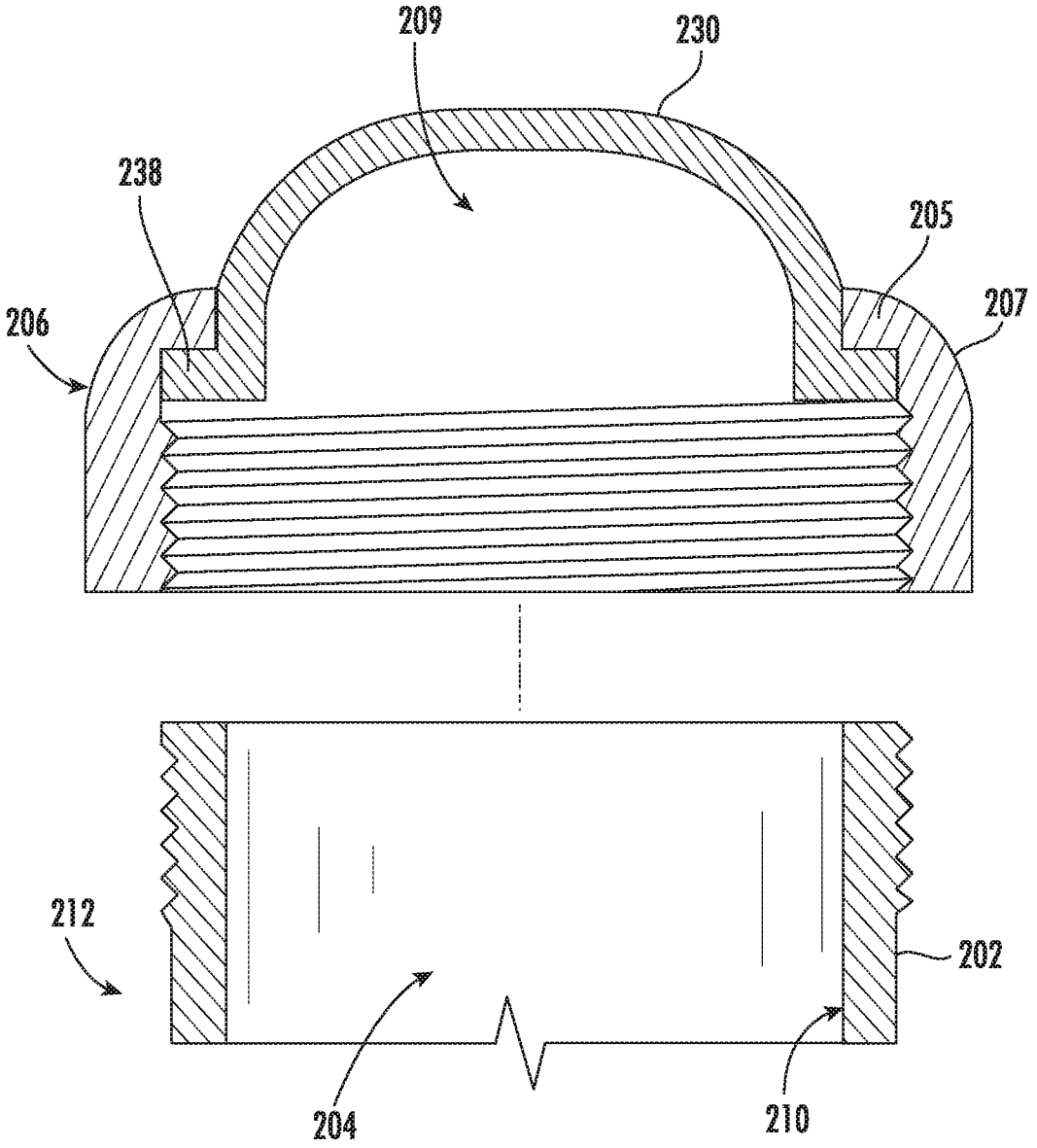
FIG. 8 provides a vertical cross-sectional view of an exemplary reservoir cap and a top portion of a reservoir.
Figure 9:
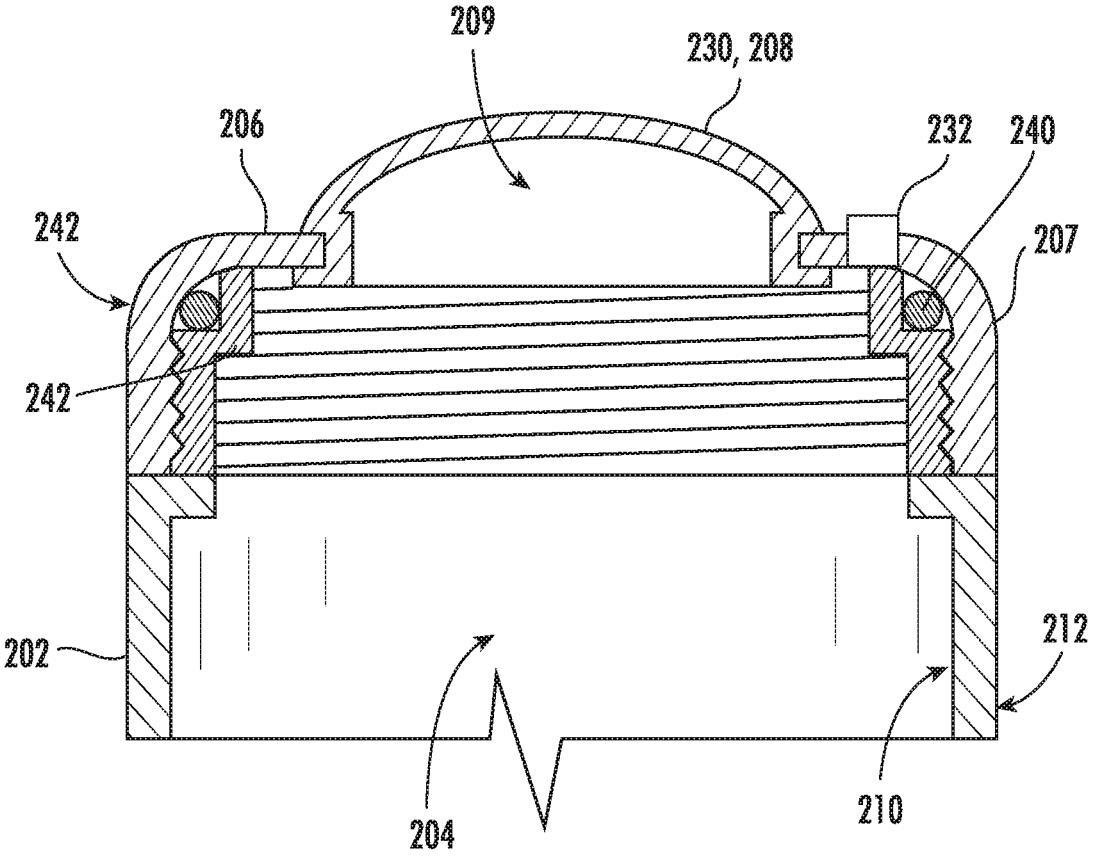
FIG. 9 provides a vertical cross-sectional view of an exemplary reservoir cap.
Figure 10:
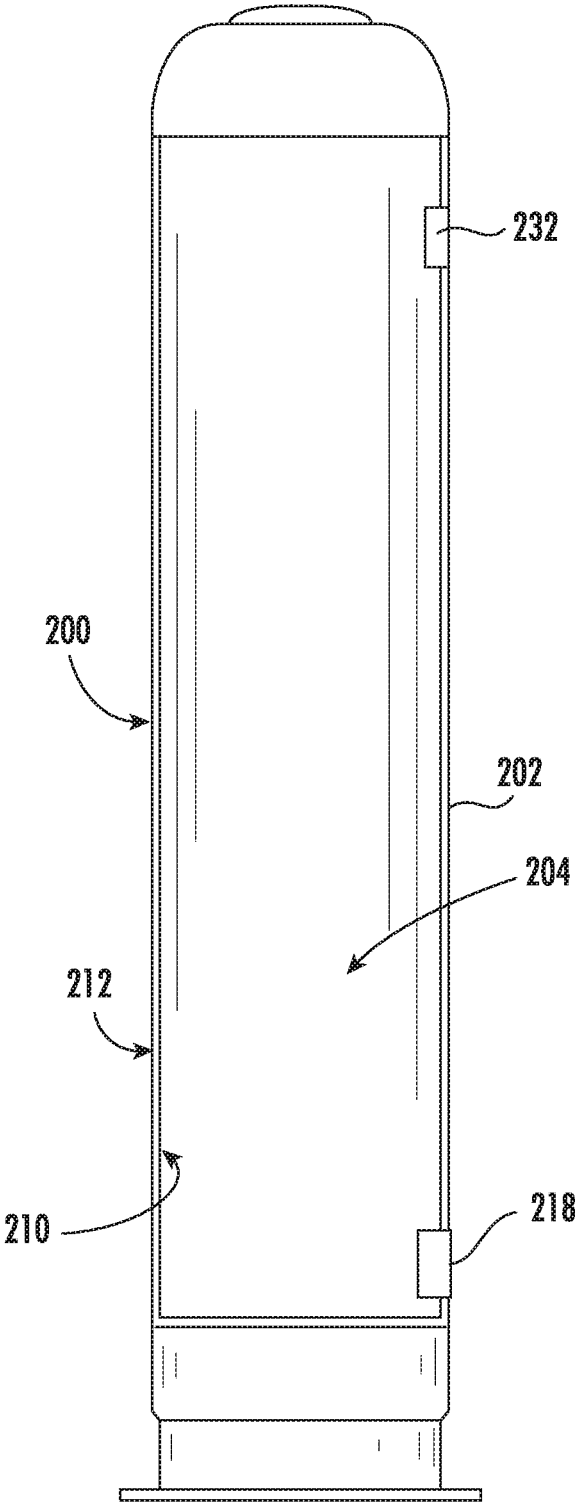
FIG. 10 provides a front perspective view of an exemplary bulk tank assembly.

As shown in FIGS. 8 through 9, bulk tank assembly 200 may further comprise a reservoir cap 206 mounted atop reservoir 202. In the embodiments of FIGS. 8 and 9, reservoir cap 206 may be removably mounted to reservoir 202. For example, reservoir cap 206 may be screwed on and off from a threaded connection atop reservoir 202. Additionally or alternatively, reservoir cap 206 may be removably mounted to reservoir 202 in another suitable manner, for example, by use of a twist-lock, snaps, clasps, or even friction. Indeed, reservoir cap 206 need not even completely disconnect from reservoir 202 to be considered removably mounted, as that phrase as used herein. For example, reservoir cap 206 may be mounted to reservoir 202 by a hinged connection (not pictured), such that rotation of reservoir cap 206 about the hinge exposes reservoir volume 204 without completely disconnecting reservoir cap 206. Additionally or alternatively, reservoir cap 206 may include a flexible tethering element (not pictured) connecting reservoir cap 206 to reservoir 202. Generally, when reservoir cap 206 is removed, users are granted access to fill reservoir 202 with cleaning agents. Replacement of reservoir cap 206 on reservoir 202 prepares bulk assembly tank for use in the next wash cycle, wherein reservoir cap 206 prevents cleaning agent from sloshing or otherwise spilling out the top of reservoir 202 as these components and their contents are rotated during the wash cycle.

In optional embodiments, reservoir cap 206 may generally aid in the prevention of leaks between reservoir 202 and reservoir cap 206. In some such embodiments, reservoir cap 206 is sealingly mounted to reservoir 202. For example, as shown in the embodiment of FIG. 8, reservoir cap 206 may comprise one or more cap walls 207 which define a cap opening 209. Generally, cap walls 207 may be shaped to form an overhang 205 at cap opening 209. Silicone dome 230 may be mounted to reservoir cap 206 through cap opening 209. Silicone dome 230 may further include an outer ring 238, the outer ring extending beneath overhang 205 such that when reservoir cap 206 is connected to reservoir 202, outer ring 238 is compressed, preventing leakage between reservoir 202 and reservoir cap 206. In an alternative embodiment, such as depicted in FIG. 9, sealing between reservoir 202 and reservoir cap 206 may be accomplished by mounting an O-ring 240 on an O-ring gland 242 situated about the threads of reservoir 202 such that when reservoir cap 206 is attached to reservoir 202, O-ring 240 is compressed, thereby preventing leakage. Other suitable arrangements of O-rings or other sealing materials (e.g., gaskets, adhesives) may be further provided as well.

The reservoir cap 206 may further comprise a manual hand pump 208 (e.g., integrated into reservoir cap 206) in fluid communication with reservoir volume 204. FIGS. 8 and 9 depict an embodiment in which manual hand pump 208 constitutes a silicone dome 230. Generally, silicone dome 230 may be depressed by the user to selectively increase pressure within reservoir 202 and thereby cause cleaning agents therein to be pumped out of reservoir 202 and into wash chamber 71 for use in the next wash cycle, as shall be addressed in greater detail below.

It should be recognized that manual hand pump 208 is not intended to be limited to silicone dome 230, but may alternatively include a dome of different plastic, rubber, or rubber-like materials.

In additional or alternative embodiments, hand pump 208 includes a dip tube dispenser 234 (e.g., as shown in FIG. 4). During use, dip tube dispenser 234 may draw cleaning agent up through dip tube 237 to reservoir cap 206 and dispense the cleaning agent through a depressible nozzle 236 mounted atop reservoir cap 206. In some embodiments, depressible nozzle 236 extends beyond reservoir 202 (e.g., such that use of depressible nozzle 236 results in a volume of cleaning agent being deposited within wash chamber 71).

As noted, actuation of manual hand pump 208 can generally cause the dispensation of a cleaning agent into wash chamber 71. In response to actuation, manual hand pump 208 may dispense a fixed volume of cleaning agent. In some such embodiments, the volume of dispensed cleaning agent is calibrated to the size of wash load. For example, a single actuation of manual hand pump 208 may dispense a proper volume of cleaning agent for a small load, two pumps may suffice for a medium load, and so on.

Turning especially to FIGS. 5 through 6 and 10 through 12, cleaning agent may be dispensed from reservoir volume 204 through fluid outlet valve 218. In some embodiments, fluid outlet valve 218 extends from inner surface 210 of reservoir 202 to outer surface 212 of reservoir 202. Generally, fluid outlet valve 218 may selectively permit the uni-directional flow of cleaning agent from inner surface 210 of reservoir 202 to outer surface 212 of reservoir 202 and, as a consequence, into wash chamber 71. Fluid outlet valve 218 may comprise a silicone cross-cut valve.

Figure 12:
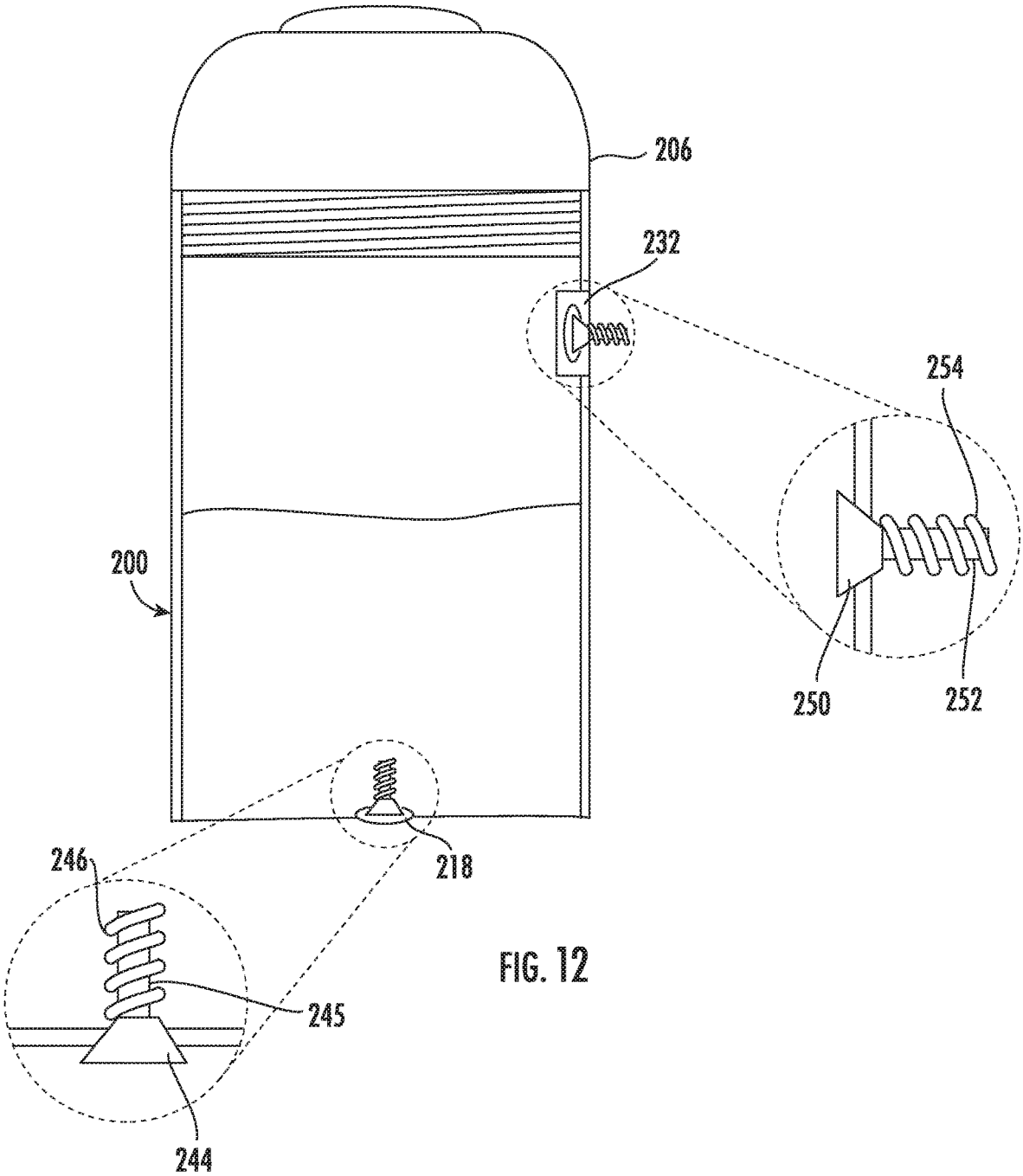
FIG. 12 provides a front perspective view of a portion of an exemplary reservoir, reservoir cap, and manual hand pump.

Additionally or alternatively, as shown in FIG. 12, fluid outlet valve 218 may comprise a spring-loaded outlet valve that includes a stopper 244 residing on the outer surface 212 of reservoir 202 and connected to a shaft 245 extending within reservoir 202. In some such embodiments, stopper 244 is selectively held in place by a spring 246 (e.g., to prevent the flow of cleaning agent through fluid outlet valve 218). In certain embodiments, actuation of manual hand pump 208 increases the pressure exerted against stopper 244 and causes compression of spring 246, thereby moving shaft 245 away from reservoir volume 204 and moving stopper 244 in the same direction and thus permitting cleaning agent to be discharged. Upon normalization of pressure within reservoir 202, spring 246 may expand, once again causing stopper 244 to create a seal.

Fluid outlet valve 218 may reside in various locations on reservoir 202. For example, in the embodiment depicted in FIG. 5, fluid outlet valve 218 may be located near the bottom of a side of reservoir 202.

In some such embodiments, reservoir 202 may generally direct cleaning agent to fluid outlet valve 218. For example, reservoir volume 204 may define a floor 220 of reservoir 202. At least a portion of floor 220 may be sloped downward toward fluid outlet valve 218, using gravity to direct cleaning agent from reservoir volume 204 to fluid outlet valve 218. Such an arrangement may advantageously increase the efficient use of cleaning agent (e.g., by preventing portions of the cleaning agent from being trapped below or on the opposite side from fluid outlet valve 218).

Figure 11:
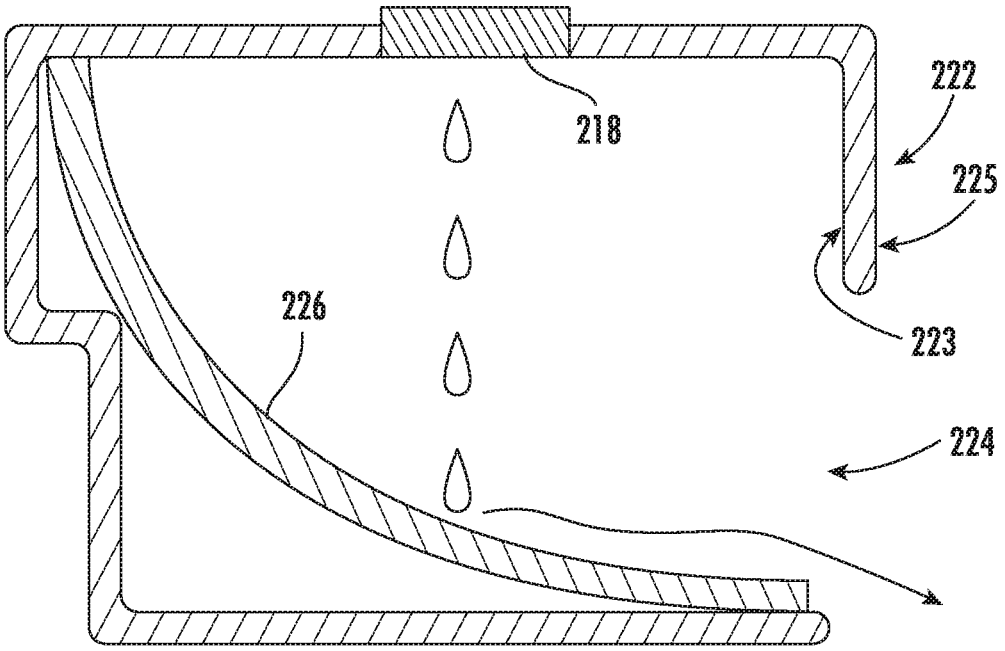
FIG. 11 provides a vertical cross-sectional view of an exemplary bottom portion of a reservoir.

In other embodiments, such as those depicted in FIGS. 3 and 11, floor 220 of reservoir 202 may be flat. In some such embodiments, reservoir 202 further comprises a bottom portion 222 and a reservoir stem 228. Reservoir stem 228 may be an elongated receptacle mounted over bottom portion 222 to selectively retain cleaning agent within reservoir volume 204. Fluid outlet valve 218, residing floor 220 of reservoir stem 228 for selectively dispensing cleaning agent into bottom portion 222. Bottom portion 222 may further include an inner surface 223 and an outer surface 225. Bottom portion 222 may define an opening 224 between inner surface 223 and outer surface 225. Bottom portion 222 may also include a sloped surface 226, as shown in FIG. 11, on an inside of bottom portion 222, at least a portion of sloped surface 226 being angled toward opening 224. Actuation of manual hand pump 208 may selectively motivate a portion of the cleaning agent from reservoir volume 204, and particularly from reservoir stem 228, through fluid outlet valve 218 and into bottom portion 222, where the cleaning agent may flow onto sloped surface 226 and may be pulled (e.g., by gravity) through opening 224 and into wash chamber 71.

In certain embodiments, following actuation of manual hand pump 208, a vacuum may be created within reservoir volume 204 as manual hand pump 208 resets or returns to its previous position. Accordingly, it may be desirable to selectively permit air into reservoir volume 204 (e.g., to equalize the pressure within reservoir volume 204). Optionally, a breather valve or an air inlet check valve 232 may be provided (e.g., as shown in FIG. 12). Air inlet check valve 232 may comprise a stopper 250 residing within reservoir volume 204 and connected to a shaft 252 extending out of reservoir volume 204. The shaft 252 may be connected to a spring 254. Additionally or alternatively, spring 254 may abut the outer surface 212 of reservoir 202. In some such embodiments, the creation of a vacuum within reservoir volume 204 will exert a suction force on stopper 250, which will pull stopper 250 and shaft 252 toward reservoir volume 204, thereby compressing spring 254 and selectively permitting air into reservoir volume 204 for equalizing the pressure. As air pressure approaches equilibrium, spring 254 may expand, pulling shaft 252 and stopper 250 away from reservoir volume 204 until stopper 250 contacts inner surface 210 of reservoir 202, thus sealing reservoir volume 204.

As shown in the embodiment of FIG. 12, air inlet check valve 232 may be located on outer surface 212 of reservoir 202. In some such embodiments, air inlet check valve 232 is positioned on or proximal to the top of reservoir 202 (e.g., closer to the top than the bottom of reservoir 202). During use, air inlet check valve 232 may be maintained above the height of any cleaning agent within reservoir 202. Additionally or alternatively, air inlet check valve may be situated on reservoir cap 206 or manual hand pump 208 (not pictured).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a cabinet;

a tub mounted within the cabinet;

a wash basket rotatably mounted within the tub, wherein the wash basket defines a wash chamber;

a base mounted within the wash chamber, the base having a top side and being rotatable relative to the wash chamber; and a bulk tank assembly mounted to the top side of the base, the bulk tank assembly comprising an elongated reservoir defining a reservoir volume to receive a cleaning agent therein; the elongated reservoir further including a bottom portion defining an opening between an inner surface and an outer surface of the bottom portion of the elongated reservoir, and a sloped surface on an inside of the bottom portion, at least a portion of the sloped surface angled toward the opening;

a reservoir stem mounted over the bottom portion to selectively retain the cleaning agent within the reservoir volume; and a fluid outlet valve mounted within the reservoir stem to selectively dispense the cleaning agent into the bottom portion; and a reservoir cap removably mounted to the elongated reservoir, the reservoir cap comprising a manual hand pump in fluid communication with the reservoir volume to selectively motivate a portion of the cleaning agent from the reservoir volume.

2. The washing machine appliance of claim 1, wherein the manual hand pump comprises a silicone dome sealingly mounted on the reservoir cap.

3. The washing machine appliance of claim 2, wherein the bulk tank assembly further comprises an air inlet check valve selectively permitting air into the reservoir volume.

4. The washing machine appliance of claim 1, wherein the manual hand pump comprises a dip tube dispenser comprising a depressible nozzle mounted on the reservoir cap.

5. A washing machine appliance comprising:

a cabinet;

a tub mounted within the cabinet;

a wash basket rotatably mounted within the tub, wherein the wash basket defines a wash chamber;

a base mounted within the wash chamber, the base having a top side and being rotatable relative to the wash chamber; and a bulk tank assembly mounted to the top side of the base, the bulk tank assembly comprising an elongated reservoir defining a reservoir volume to receive a cleaning agent therein, the elongated reservoir further including a bottom portion defining;

an opening between an inner surface and an outer surface of the bottom portion of the elongated reservoir;

a sloped surface on an inside of the bottom portion, at least a portion of the sloped surface angled toward the opening;

a reservoir stem mounted over the bottom portion to selectively retain the cleaning agent within the reservoir volume; and a valve mounted within the reservoir stem to selectively dispense the cleaning agent into the bottom portion; and a manual hand pump mounted on a top of the elongated reservoir, wherein the pump may be actuated to dispense the cleaning agent.

6. The washing machine appliance of claim 5, wherein the manual hand pump comprises a silicone dome sealingly mounted on the top of the elongated reservoir.

7. The washing machine appliance of claim 6, wherein the bulk tank assembly further comprises an air inlet check valve selectively permitting air into the reservoir volume.

8. The washing machine appliance of claim 5, wherein the manual hand pump comprises a dip tube dispenser comprising a depressible nozzle mounted on the top of the elongated reservoir.

9. The washing machine appliance of claim 1, wherein the elongated reservoir comprises an inner surface directed toward the reservoir volume and an outer surface directed away from the reservoir volume, the elongated reservoir further comprising a plurality of distribution ribs extending from the inner surface within the reservoir volume of the elongated reservoir.

10. The washing machine appliance of claim 1, wherein the base is an impeller.

11. The washing machine appliance of claim 1, wherein the elongated reservoir comprises an inner surface directed toward the reservoir volume and an outer surface directed away from the reservoir volume, and wherein the elongated reservoir further comprises a plurality of vertical agitating fins extending from the outer surface of the elongated reservoir within the wash basket.

12. The washing machine appliance of claim 5, wherein the elongated reservoir comprises an inner surface directed toward the reservoir volume and an outer surface directed away from the reservoir volume, the elongated reservoir further comprising a plurality of distribution ribs extending from the inner surface within the reservoir volume of the elongated reservoir.

13. The washing machine appliance of claim 5, wherein the base is an impeller.

14. The washing machine appliance of claim 5, wherein the elongated reservoir comprises an inner surface directed toward the reservoir volume and an outer surface directed away from the reservoir volume, and wherein the elongated reservoir further comprises a plurality of vertical agitating fins extending from the outer surface of the elongated reservoir within the wash basket.

* * * * *